United States Patent [19]

Witkowicz

[11] 4,139,767

[45] Feb. 13, 1979

[54] PHOTODETECTOR WITH IMPROVED SIGNAL-TO-NOISE RATIO

[75] Inventor: Tadeusz Witkowicz, Ottawa, Canada

[73] Assignee: Northern Telecom Limited, Montreal, Canada

[21] Appl. No.: 842,622

[22] Filed: Oct. 17, 1977

[51] Int. Cl.[2] ..... H01J 39/12

[52] U.S. Cl. ..... 250/214 A; 250/214 R

[58] Field of Search ..... 250/214 A, 214 R

[56] References Cited

U.S. PATENT DOCUMENTS

| | | | |
|---|---|---|---|
| 2,616,289 | 11/1952 | Kleckmer | 250/214 R X |
| 3,430,106 | 2/1969 | McDowell | 250/214 A X |

*Primary Examiner*—David C. Nelms
*Assistant Examiner*—Darwin R. Hostetter
*Attorney, Agent, or Firm*—Achmed N. Sadik

[57] ABSTRACT

A novel photodetector circuit utilizing both the generated photovoltage, as well as its inverse, to improve the signal-to-noise ratio at the optical receiver output.

2 Claims, 3 Drawing Figures

PHOTODETECTOR WITH IMPROVED SIGNAL-TO-NOISE RATIO

FIELD OF THE INVENTION

The present invention relates to photodetection in general, and particularly to receivers for amplifying diode photodetector currents.

BACKGROUND AND PRIOR ART OF THE INVENTION

The field of fibre-optic transmission and reception is on the verge of massive penetration of the electrical communications market. Due to the low attenuation characteristics of optical fibres over the relatively wide frequency bands of transmission, relatively large repeater spacings and hence substantially reduced costs are possible. A decrease in attenuation of fibres by a few decibels per kilometer means a corresponding increase in distance between repeaters. Of course, there exists a theoretical limit to the reduction in the attenuation, and, surprisingly, some of the latest fibres are quite close to this theoretical limit. Any further improvements in repeater spacing will have to, sooner or later, be sought elsewhere.

As is well understood in the art of electrical communications, an improvement in signal-to-noise ratio (SNR) at the receiving end of a transmission system is equivalent to, and as desirable as, a reduction in the attenuation of that transmission path. An increase in SNR of 3 decibels in a system having a transmission path exhibiting, say, 7 decibels per kilometer would, theoretically, permit an increase in repeater spacing of up to 0.2 kilometer. This, of course, provided that the receiving amplifier directly connected to the photoelectric converter (often a PIN diode) is the limiting factor in SNR determination. While this is the case with PIN photodiodes, it is not the case with avalanche photodiodes, which are limited by internal shot noise. Nevertheless, an advantage still accrues with avalanche photodiodes due to lower avalanche gain requirements due to the effective decrease in amplifier noise.

The conventional way of connecting a photodetector to its associated receiver-amplifier is by tapping the junction between the photodetector and its load resistor. Photons impinging on the reverse-biased detector generate a photocurrent proportional to their intensity, which current flows through the single load resistor and develops a proportional photovoltage thereacross.

SUMMARY OF THE INVENTION

It has been found that, instead of using a single load resistor as heretofore taught in the art, when two load resistors were used on either side of the photodetector and the function between the second load resistor and the photodetector was tapped as well, a signal enhancement should result. Since the signal photovoltages across the two load resistors are coherent, while the noise voltages are not, a theoretical gain of 3 decibels in SNR should be obtained. One problem, however, is that either of the two photovoltages is the inverse of the other, and superposition thereof must take this into consideration.

Thus, according to the present invention there is provided a photodetector circuit comprising: a photodetector having first and second terminals connected to first and second load resistors, respectively, and biased therethrough by means of a voltage source; the junctions of said first and second terminals with said first and second load resistances being two, mutually inverse signal outputs of said photodetector circuit with reference to said voltage source.

In the preferred embodiment of the present invention, the above photodetector circuit drives a differential amplifier, having its inputs connected one to the first and the other to the second of said two signal outputs. At the output of the differential amplifier, since it has one inverting and one non-inverting input, a signal enhancing superposition of the two photovoltages obtain. If suitable, a push-pull-to-single ended transformer may be used to combine the photovoltages and drive a single ended amplifier.

BRIEF DESCRIPTION OF THE DRAWINGS

A preferred embodiment will now be described in conjunction with the accompanying drawings in which.

DESCRIPTION OF THE PREFERRED EMBODIMENT

Figure 1:
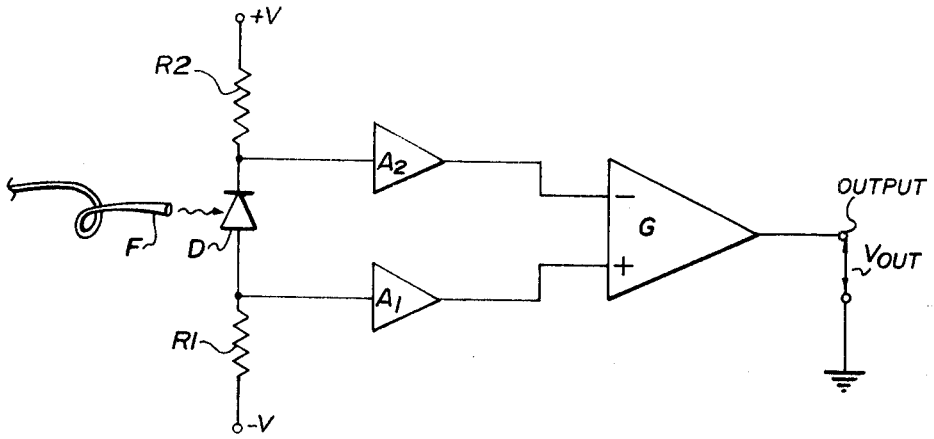
FIG. 1 is a block schematic showing the photodetector circuit and following receive circuitry according to the present invention.

FIG. 1 of the drawings shows an optical fibre F as a transmission link emitting light to impinge on a PIN photodetector diode D. The diode D is biased from a pair of terminals $-V$ and $+V$ via load resistors R1 and R2. The resistors R1 and R2 develop a d-c voltage drop due to a leakage current in the diode D, on which the signal voltage drops V1 across R1 and V2 across R2 is superposed when light impinges on the diode D and generates a photocurrent. The signal voltages V1 and V2 are buffered by preamplifiers A1 to A2 to differential/amplifier G, at the output of which a useful output signal voltage $V_{out}$ is obtained. The voltage V1 is amplified uninverted by the amplifier G while the voltage V2, which, for R1 = R2 (suitable value ca. $10^7$ ohms), is equal to V1 in magnitude but opposite in sign (i.e. V1 = $-$V2), is inverted by the amplifier G, and hence enhances the resultant output signal voltage $V_{out}$. While it is true that also the noise output voltage is enhanced at the output of the amplifier G, such noise voltage enhancement follows a 10 log addition law due to the incoherency of the equivalent noise sources at the two inputs of the amplifier G. The signal voltages V1 and V2, however, follow a 20 log addition law because they are always coherent (i.e. in-phase). For identical components in the paths of the voltages V1 and V2, in addition to R1 being equal to R2, a theoretical improvement in the signal-to-noise ratio (SNR) by a factor of 2, equivalent to 3 decibels, results.

The above considerations with regard to the improved SNR should be apparent to those skilled in the art without further elaboration or discussion. Indeed, such is probably the case upon brief examination of FIG. 1 in contrast with the prior art. In the prior art, only one-half of the circuit shown is used (comprising the diode D but only one of R1/A1 or R2/A2), with a single ended amplifier instead of the differential amplifier G. It should be also understood that the preamplifiers A1 and A2 may be incorporated into, or considered part of, the amplifier G. This, however, is only a matter of definition. Discussed briefly below is an amplifier shown in FIG. 2 which makes this point abundantly clear.

Figure 2:
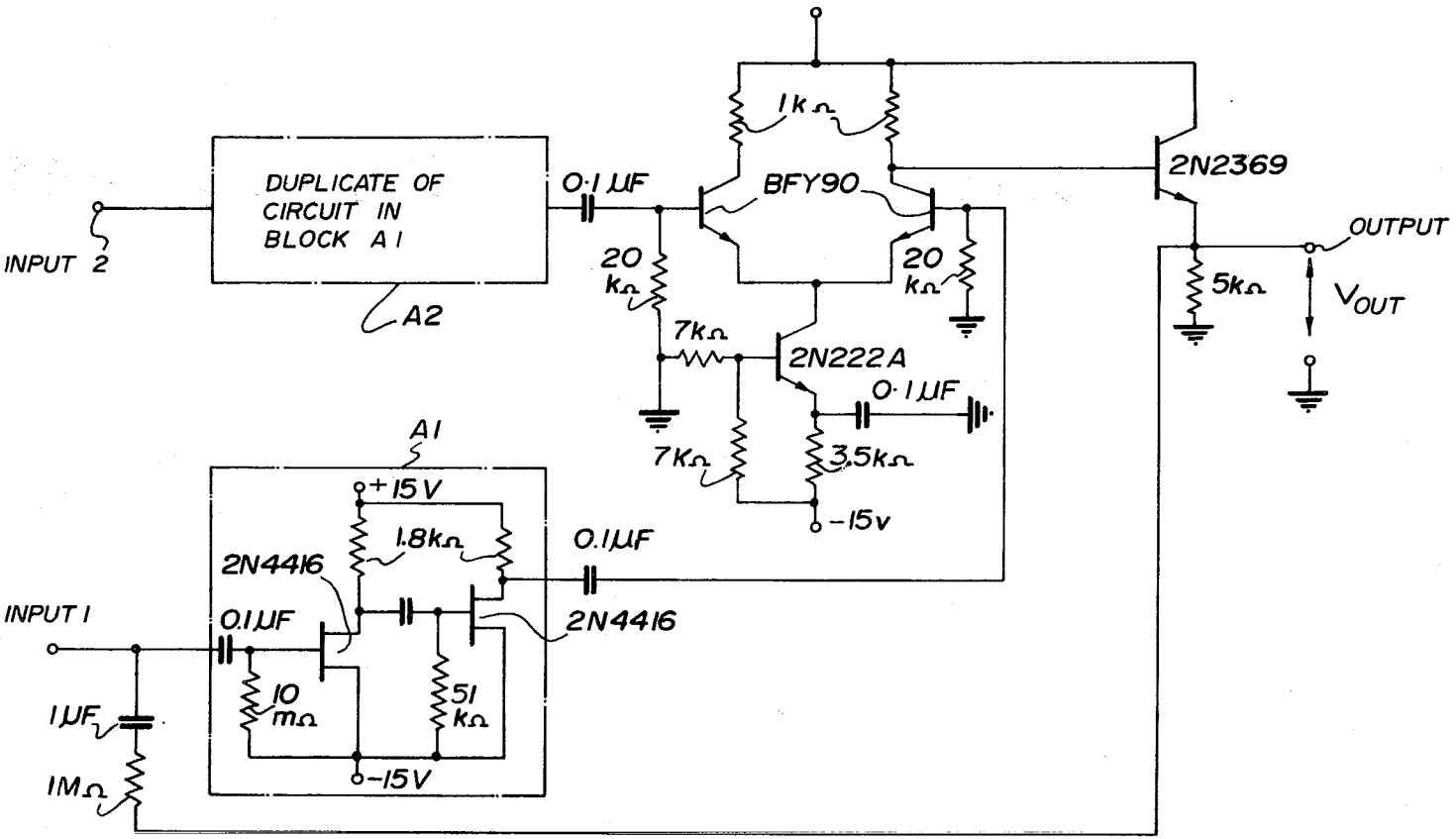
FIG. 2 is a detailed circuit schematic of a suitable example of the receive circuitry shown in FIG. 1.

FIG. 2 of the drawings shows in detail the conventional design of an amplifier suitable for the application at hand. Such amplifier, as disclosed in FIG. 2 of the drawings, is believed self-explanatory. All components designations and values are given in FIG. 2. Suffice it to state that, for reasons of high input impedance and good noise performance, the preamplifiers A1 and A2 utilize field-effect transistors, while the actual differential amplifier G itself utilizes bipolar transistors — all in conventional and well known circuit techniques. Clearly, suitable off-the-shelf differential amplifiers may be utilized.

Figure 3:
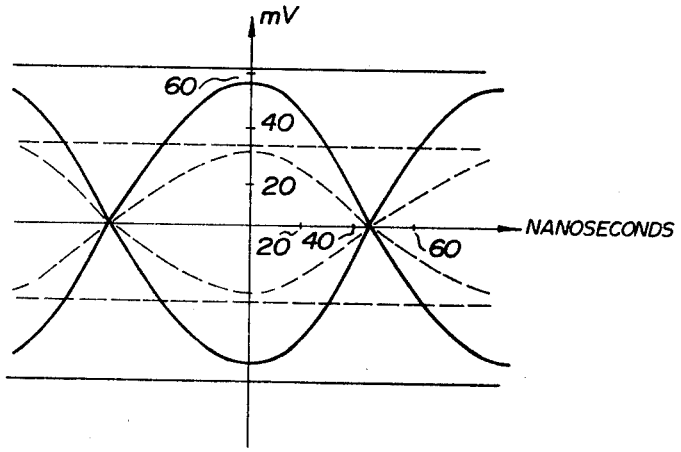
FIG. 3 located on the same sheet as FIG. 1, is an illustration of an improvement in the eye diagram of photodetector and receiver according to the present invention compared to the prior art, both used to detect and receive the same digitally modulated light beam.

Finally, FIG. 3 of the drawings shows a comparison between the performance of the novel photodetector/-receiver and the single ended photodetector/receiver of the prior art. The figure shows the so-called "Eye Diagram" indicating the improved SNR of the differential photodetector/receiver (solid tracings) as opposed to the eye diagram of the conventional photodetector/-receiver (dotted tracings). These are superposed tracings of actual oscilloscope displays taken while receiving a digital pulse stream of 11.1 megabits/second. Of course, the improved SNR obtains with both digital and analog signals.

What is claimed is:

1. A photodetector/receiver circuit comprising:

a voltage source having a positive and a negative terminal;

a first resistor connected between said positive terminal and the cathode of a photodetector diode;

a second resistor substantially equal in resistance value to said first resistor, connected between said negative terminal and the anode of said photodetector diode;

said anode and cathode capacitively coupled, one to the inverting input of a differential amplifier, and the other to the noninverting input; and the output of said differential amplifier comprising the output of said photodetector/receiver circuit.

2. The photodetector/receiver of claim 1, said photodetector diode being a PIN diode coupled to a fibre optic transmission cable to receive modulated light transmitted therethrough.

* * * * *